US009955807B2

(12) United States Patent
Cohara

(10) Patent No.: US 9,955,807 B2
(45) Date of Patent: May 1, 2018

(54) ADJUSTABLE DRINKING CUPS

(71) Applicant: Matthew Cohara, Ankeny, IA (US)

(72) Inventor: Matthew Cohara, Ankeny, IA (US)

( * ) Notice: Subject to any disclaimer, the term of this patent is extended or adjusted under 35 U.S.C. 154(b) by 59 days.

(21) Appl. No.: 15/150,037

(22) Filed: May 9, 2016

(65) Prior Publication Data

US 2017/0318992 A1 Nov. 9, 2017

(51) Int. Cl.
*A47G 19/22* (2006.01)
*B65D 83/00* (2006.01)

(52) U.S. Cl.
CPC ..... *A47G 19/2205* (2013.01); *B65D 83/0005* (2013.01)

(58) Field of Classification Search
CPC ..... A47G 2200/048; A47G 19/2205; A47G 19/2266; A47G 19/2277; A47G 19/34; A47G 19/183; A61J 7/0023; A61J 7/0046; B65D 1/265; B65D 47/06; B65D 81/3865; B65D 81/325; B65D 83/0022; B65D 83/0005; B65D 83/0055; B67D 1/0004; B67D 3/007; B65B 61/18; B05C 17/00553; B05C 17/00559; G01F 19/00; G01F 19/002; G01F 19/005
USPC .... 220/703, 720, 8; 222/309, 390, 490, 386; 215/900, 11.1, 11.6; 604/78
See application file for complete search history.

(56) References Cited

U.S. PATENT DOCUMENTS 560,916 A * 5/1896 Mcdonaugh ..... A47G 19/2266 220/703
D34,708 S * 7/1901 Evans ..... D24/110
860,501 A * 7/1907 Tatum ..... A47G 19/2266 220/703
1,334,346 A * 3/1920 Boehm ..... B65D 83/0005 206/526
1,575,870 A * 3/1926 Sehlbach ..... A47G 19/2205 215/383
2,012,113 A * 8/1935 Thompson ..... A47G 19/2205 215/363
2,399,813 A * 5/1946 Lucas ..... G01F 19/005 292/256.63
2,519,271 A * 8/1950 Miller ..... B65D 83/0005 206/229

(Continued)

OTHER PUBLICATIONS http://www.rehabmart.com/category/cups,_mugs_and_accessories.htm, "Cups / Mugs / Water Pitcher / Nosey Cup / Straws / No Spill Cup /Drinking Glasses" retrieved from the Internet on Apr. 29, 2016, 43 pages.

*Primary Examiner* — J. Gregory Pickett
*Assistant Examiner* — Gideon Weinerth
(74) *Attorney, Agent, or Firm* — Zarley Law Firm, P.L.C.

(57) ABSTRACT

The present invention relates to an adjustable drinking cup that limits the risk of aspiration by retaining a neutral neck position or by permitting a patient to tuck their chin while drinking. The adjustable drinking cup has a continuous wall formed by an exterior and interior surface that extends between a top and bottom end. The continuous wall forms a top and bottom opening. A plunger is received within the bottom opening. During use the patient fills the adjustable drinking cup with a liquid and after a predetermined amount of liquid is consumed the plunger is pressed upwards to raise the liquid to a predetermined position near the top opening. This is repeated each time a predetermined amount of liquid is consumed.

14 Claims, 7 Drawing Sheets

(56) References Cited

U.S. PATENT DOCUMENTS 2,627,735 A * 2/1953 Dexter ..... A47G 19/2266 220/703
2,690,080 A * 9/1954 Rich ..... G01F 19/00 222/386
2,839,928 A * 6/1958 Fohrman ..... G01F 19/005 249/155
3,273,760 A * 9/1966 Frankenberg ..... B65D 83/0005 220/301
3,297,194 A * 1/1967 Caldwell ..... B65D 1/10 220/672
3,514,008 A * 5/1970 Dorn ..... A61J 7/0046 206/218
3,920,156 A * 11/1975 Hicks ..... A47G 19/183 222/326
4,116,071 A * 9/1978 Sakura ..... G01F 19/00 73/429
5,078,287 A * 1/1992 Holmes, III ..... A61J 9/00 215/11.1
5,133,485 A * 7/1992 Ohno ..... A47G 19/2266 222/386
5,449,089 A * 9/1995 Turner ..... A47G 19/2205 220/675
6,048,014 A * 4/2000 Stefanik ..... A23G 7/00 206/804
6,126,632 A * 10/2000 Verbovszky ..... A47G 19/2266 220/712
6,138,848 A * 10/2000 Fermo ..... A61J 9/00 215/11.1
8,181,816 B2 * 5/2012 Allen ..... A47G 19/2266 206/218
8,757,053 B2 * 6/2014 Gonzalez ..... A47J 36/2483 221/150 A
9,114,062 B1 * 8/2015 McGee ..... A61J 9/005
2007/0272698 A1 * 11/2007 Brown ..... B65D 21/08 220/578
2009/0110786 A1 * 4/2009 Wells ..... B65D 85/78 426/115
2011/0049170 A1 * 3/2011 Wheeler ..... B65D 35/44 220/708
2011/0290826 A1 * 12/2011 Harris ..... B65D 83/0044 222/319
2012/0065608 A1 * 3/2012 Costello ..... A61J 9/00 604/403
2012/0261431 A1 * 10/2012 Sharba ..... A47G 19/2266 220/709
2013/0313271 A1 * 11/2013 Speciale ..... A47G 19/2266 220/719
2015/0151896 A1 * 6/2015 Jethwani ..... A47G 19/183 222/1
2015/0375907 A1 * 12/2015 Yamasaki ..... B65D 47/06 222/490
2017/0101303 A1 * 4/2017 Tomesch ..... B65D 83/0005

* cited by examiner

ADJUSTABLE DRINKING CUPS

BACKGROUND OF THE INVENTION

This invention is directed toward drinking cups used in a patient care setting. More specifically, and without limitation, this invention relates to an adjustable drinking cup.

Drinking cups are well known in the art. In the health care field, aspiration, or the inhalation of liquid or material into the lungs, is a major concern, as it can lead to lung infection or what is more commonly referred to as pneumonia. The risk for aspiration increases the greater a patient extends their neck while drinking. The increased risk is the result of permitting the fluid to act under the influence of gravity thereby entering the trachea instead of the esophagus. The risk of aspiration is heightened further in cases involving patients who have recently suffered from a stroke. As such, care givers strive for drinking cups that permit the patient to retain their neck in a neutral position where the chin is not raised, or if possible, a position where the chin is tucked to further prevent aspiration.

Another related issue pertains to patients who cannot cope with quickly flowing fluids that come from the bottom of a cup. In this circumstance, the patient raises their cup to drink the remaining portion of their drink, but the drink travels from the bottom of their cup at a sharp slope to their mouth at a high velocity, and results in aspiration. This is especially problematic when a caregiver attempts to pour the liquid into a patient's mouth.

Yet another issue related to drinking cups concerns patients with limited range of arm motion. These patients encounter issues consuming all of the liquids they are provided as part of their diets. This is caused by an inability to sufficiently raise their cup to empty the contents into their mouths. As a result, these patients go without sufficient hydration or must repeatedly refill their cups, which ultimately leads to waste as a portion of their drink is never consumed.

Given these problems in the field, a number of advancements have been made. One such advancement is what is referred to as the nosey cup. The nosey cup has a portion of the cup cut out in order to accommodate the tip and bridge of the patient's nose. In other iterations based on the same concept, the top of the cup slopes downward so that one side of the cup is substantially lower than the other. By making room for the patient's nose, the cup can be raised further up thereby allowing more liquid to be poured into the patient's mouth without the patient having to extend their neck backwards risking aspiration.

This design, however, has its deficiencies. The primary deficiency is it appears different from other cups, which causes a loss of dignity for the patient. Retaining a patient's dignity is an utmost concern for health care providers, hospitals, state health administrations, as well as the patients and, therefore, a tremendous amount of emphasis and commercial value is placed on designs that retain a patient's dignity.

Another deficiency to this advancement is its failure to address patients with limited arm mobility. If a patient has suffered a bone or muscle injury that limits their range of motion, they will not be able to raise the nosey cup the extra distance provided by the space cut away for their nose.

One other solution to this problem is the use of straws. By inserting a straw into a cup, the patient can use suction to draw the liquid into their mouth without extending their neck. This is also useful for patients with limited mobility as the straw can extend to their mouth.

This design also suffers from deficiencies. In particular, a straw can be difficult to manipulate and get to a patient's mouth; especially if the patient has limited mobility or has suffered from a stroke. In attempting to manipulate the location of the straw and get it into their mouth, a great amount of dignity can be lost for a patient.

Straws in general also pose the problem of a patient accidentally drawing too much liquid too quickly into their mouth, which can lead to choking or aspiration. Also, straws have a narrow tubular design making them difficult to clean, which results in increased disposal which causes increased costs and waste.

To address this particular deficiency, sippy cups have been developed. These cups have lids that have a nozzle that is pointed in a single directed for the patient to use. Some sippy cups also have limited amounts of liquid that can be drawn up at a time to prevent choking and aspiration hazards.

As with the other advancements, these designs also have deficiencies. Many of the designs resemble children's cups and therefore severely diminish a patient's dignity. Further, the nozzles are often stubby which prevents patients with limited arm mobility from using the sippy cup unless the nozzle reaches their mouth. Additionally, like straws, sippy cups can also be difficult to clean, especially if there are mechanisms to restrict the amount of fluid that can be withdrawn from the cup.

Another solution is to place handles on the cup. Handles permit the use a greater grip on the cup, which can be beneficial if the patient's hand or arms have been injured, or if the patient has suffered a stroke. Handles can also extend the patient's range of motion.

A handled cup, however, fails to assist with the risk of aspiration as the patient will still extend their neck backwards to consume the contents at the bottom of the cup. Also, the handles in many cases can cause the cups to look odd, which diminishes the patient's dignity.

For the reasons stated above, and for other reasons stated below which will become apparent to those skilled in the art upon reading and understanding the specification, there is a need in the art for an adjustable drinking cup.

Thus, it is a primary objective of this invention to provide an adjustable drinking cup that improves upon the art.

Another objective of this invention is to provide an adjustable drinking cup that is inconspicuous and retain patient dignity.

Yet another objective of this invention is to provide an adjustable drinking cup that is easy to use.

Another objective of this invention is to provide an adjustable drinking cup that is easy to clean and reuse.

Yet another objective of this invention is to provide an adjustable drinking cup that reduces the risk of aspiration.

Another objective of this invention is to provide an adjustable drinking cup that improves hydration for patients with limited range of arm mobility.

Yet another objective of this invention is to provide an adjustable drinking cup that is user friendly and has a limited number of parts.

Another objective of this invention is to provide an adjustable drinking cup that maximizes the amount of fluid that can be held in the cup.

These and other objectives, features, and advantages of the invention will become apparent from the specification and claims.

SUMMARY OF THE INVENTION

Figure 1:
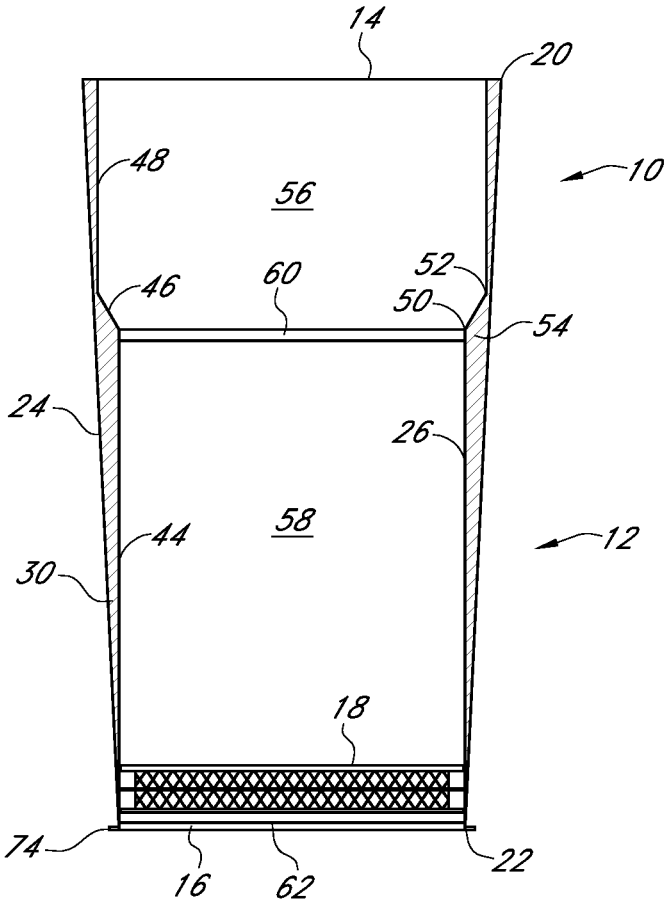
FIG. 1 is a cut-away view of an adjustable drinking cup.
Figure 2:
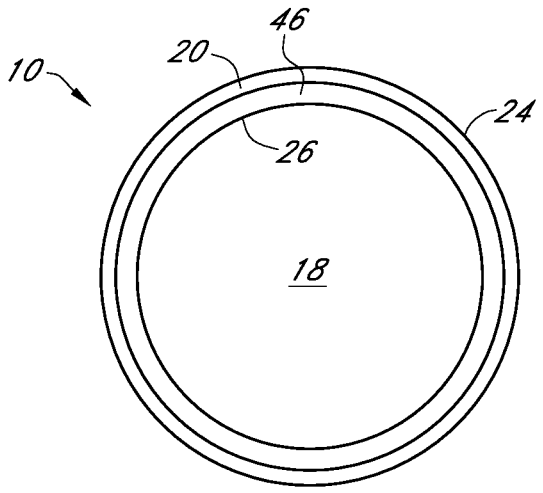
FIG. 2 is a top view of an adjustable drinking cup.
Figure 3:
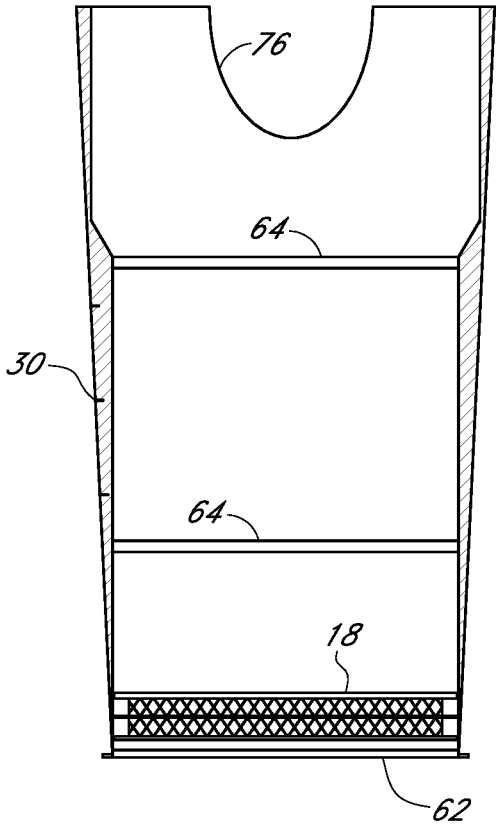
FIG. 3 is a front cut-away view of an adjustable drinking cup.
Figure 4:
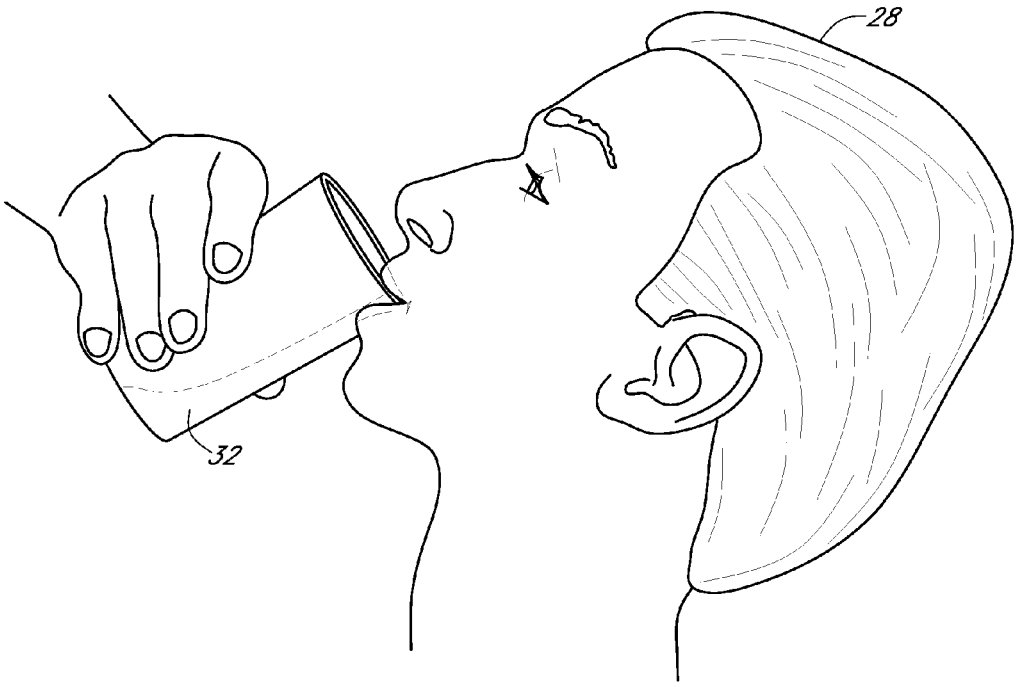
FIG. 4 (PRIOR ART)
FIG. 4 is a side view of a prior art drinking cup.
Figure 5:
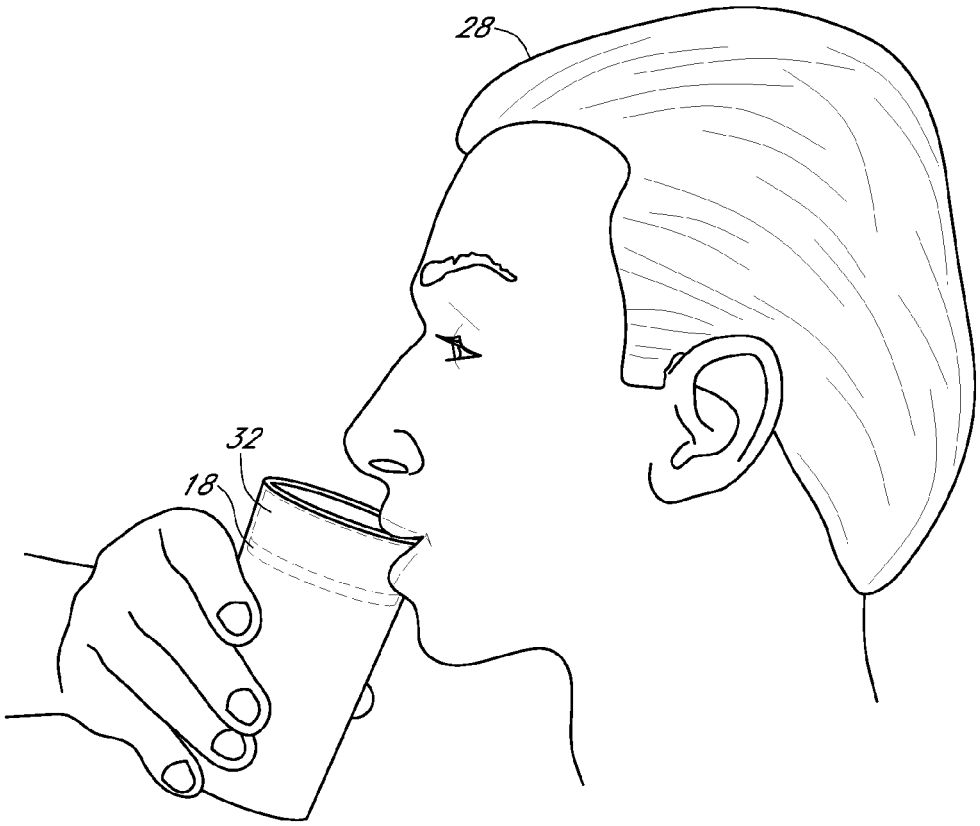
FIG. 5 is a side view of an adjustable drinking cup.
Figure 6:
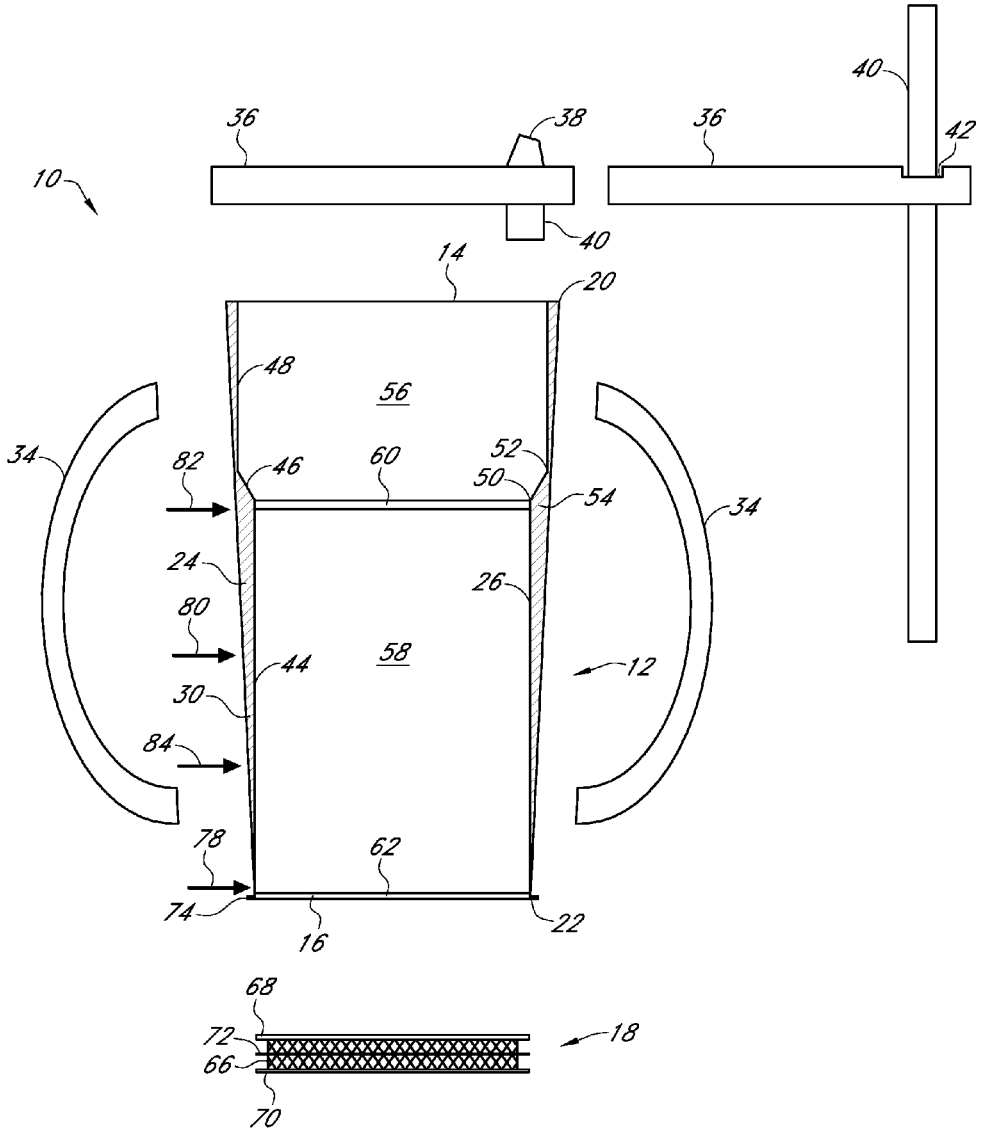
FIG. 6 is an exploded view of an adjustable drinking cup.
Figure 7:
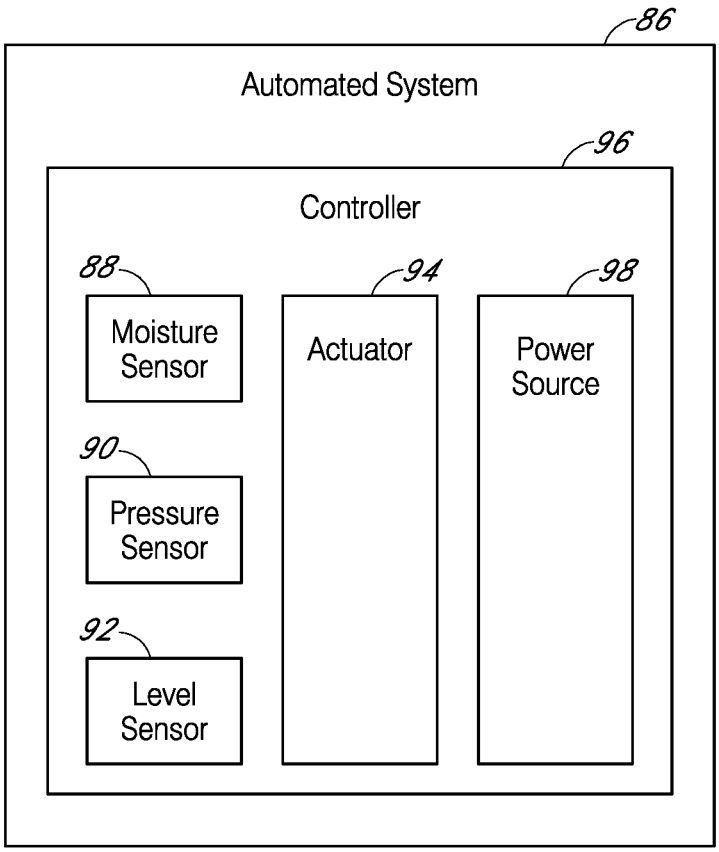
FIG. 7 is a schematic of an automated system.

In general, the present invention relates to an adjustable drinking cup. The present invention relates to an adjustable drinking cup that limits the risk of aspiration by retaining a patient's neck in a neutral position or by permitting a patient to tuck their chin while drinking. The adjustable drinking cup has a continuous wall formed by an exterior and interior surface that extends between a top and bottom end. The continuous wall forms a top and bottom opening. A plunger is received within the bottom opening. During use the patient fills the adjustable drinking cup with a liquid and after a predetermined amount of liquid is consumed the plunger is pressed upwards to raise the liquid to a predetermined position near the top opening. This is repeated each time a predetermined amount of liquid is consumed.

The present invention provides the unique advantage of an inconspicuous design that maintains the dignity of the patient as the adjustable drinking cup resembles a normal drinking cup to third party observers. The limited number of moving parts provides an easy to use and easy to clean benefit over the prior art. By providing liquid near the top of the adjustable drinking cup whenever desired, the adjustable drinking cup permits those with limit mobility access to the contents and also limits the risk of aspiration.

DETAILED DESCRIPTION

With reference to the figures, an adjustable drinking cup 10 is shown having a continuous wall 12, which forms a top opening 14 and a bottom opening 16, and a plunger 18 that is received within the bottom opening 16.

The continuous wall 12 extends from a top end or lip 20 and a bottom end 22. The continuous wall 12 can be of any shape and size, but in the illustrative embodiment the continuous wall 12 is cylindrical. In other embodiments, the continuous wall 12 is rectangular. The continuous wall 12 in one embodiment is made of clear plastic in order to be seen through. In other embodiments, the continuous wall 12 can be made out of any suitable material.

The continuous wall 12 is formed between an exterior surface 24 and an interior surface 26. The exterior surface 24 extends upwardly and outwardly from the bottom end 22 towards the top end 20. The sloped exterior surface 24 prevents the adjustable drinking cup 10 from slipping while being held by a patient 28. In other embodiments, the exterior surface 24 extends upwardly in parallel spaced alignment and in still other arrangements the exterior surface 24 is stepped, ribbed, or has a texture or design to facilitate gripping by the patient 28.

In one arrangement, the exterior surface 24 has marked indicia 30 to indicate the amount of a liquid 32 contained within the adjustable drinking cup. In other arrangements, no indicia 30 is present.

In some arrangements of the present invention, one or more handles 34 are attached to the exterior surface 34. The handles 34 facilitate the patient's 28 ability to hold the adjustable drinking cup 10 and can extend the patient's 28 reach.

A lid 36 is received over the top end 20 of the adjustable drinking cup 10 in some arrangements. A nozzle 38 is molded into or attached to the lid 36. In this arrangement, the lid prevents spilling while also extending the range that the patient 28 can reach the liquid 32 from. In a variation of this arrangement, nozzle 38 is connected to a straw 40 that extends into the adjustable drinking cup 10. The lid 36 in one arrangement has an opening 42 rather than the nozzle 38 that receives the straw 40 that extends through the opening 42 and into the adjustable drinking cup 10.

The interior surface 26 of the continuous wall 10 in one embodiment of the present invention has three portions, a first parallel portion 44, a second sloped or slanted portion 46, and a third parallel portion 48. The first parallel portion 44 in this embodiment extends upwards in parallel spaced alignment from the bottom end 22 to two-thirds up the height of the continuous wall 12. In other embodiments, the distance is approximately two-thirds, and in still other embodiments the distance is greater or less than two-thirds.

The second sloped portion 46 extends between a first end 50 and a second end 52. From the first end 50 the second sloped portion 46 extends outwardly from the first parallel portion 44 towards the exterior surface 24, such that a thickness 54 of the continuous wall is thinner at the second end 52 of the second sloped portion 46.

From the second end 52 of the second sloped portion 46, the third parallel portion 48 extends upwardly in parallel spaced alignment to the top opening 14, which extends across the top end 20 so that the user can easily drink from the adjustable drinking cup 10. In this manner, the second sloped portion 46 and the third parallel portion 48 form a reservoir 56 within an interior 58 of the adjustable drinking cup, such that more of the liquid 32 is can be held in the reservoir 56.

A top ring or protrusion 60 extends around the interior surface 26 along the first end 50 of the sloped second portion 46. The top ring 50 prevents the plunger 18 from passing easily beyond this point. A bottom ring or protrusion 62 extends around the interior surface 26 along the bottom end 22 to prevent the plunger 18 from falling out the bottom opening 16 of the adjustable drinking cup. In other arrangements, one or more rings 64 are positioned between the top ring 60 and the bottom ring 62 to act as stops to facilitate the movement of the plunger 18 so that too much of the liquid 32 is not moved upwards at once.

In an alternative embodiment, the interior surface 26 includes the top ring 60, but does not include the first parallel portion 44, the sloped portion 46, or the third parallel portion 48, and instead the interior surface 26 extends upwards in parallel spaced alignment from the bottom end 22 to the top end 20. In another iteration of this embodiment, the top ring 60 is not present. In yet another iteration, the top ring 60 is adjacent or runs along the top end 20, such that the plunger 18 is prevented from easily clearing the top opening 14.

The plunger 18 has a main body 66 that has a top surface 68, a bottom surface 70, and one or more ridges 72 that extend radially outward. In this configuration, there is a plurality of gaps that are formed between the ridge 72 and the top surface 68 and the bottom surface 70 because the main body 66 is inset from the rest of the plunger 18.

In the embodiment shown, the plunger 18 has one ridge 72. The top surface 68, the bottom surface 70, and the ridge 72 are sized and shaped to be friction fitted into the bottom opening 16 and thus are sized and shaped to conform to the first parallel portion 44. The top surface 68, the bottom surface 70, and the ridge 72 are made of rubber or other suitable matter that is capable of providing a seal that is water tight while still capable of movement with minimal effort in a friction-fit environment.

The top surface 68 can be of any shape and size, but in one arrangement the top surface 68 has a conical shape to facilitate movement upwards through the interior 58 of the adjustable drinking cup 10. In other embodiments, the top surface 68 has a flat planar surface to maximize the capacity of the adjustable drinking cup 10. In still other embodiments, the top surface 68 is convex or rounded. The bottom surface 70 in the illustrative embodiment is flat planar to provide additional stability. In other embodiments, the bottom surface 70 is concave to provide the patient 28 with a centralized location to press upwards. The ridge 72 has a thin profile to allow the ridge 72 to flex easily as it slides along the interior surface 26.

In one example of the present invention, the main plunger 18 extends a sufficient distance between the top surface 68 and the bottom surface 70 that the plunger 18 cannot rotate within the interior 58 of the adjustable drinking cup 10. For instance, if pressure is applied to one side of the bottom surface 70, the opposing side of the top surface 68 typically would have a tendency to rotate as a result of the pressure. However, due to the thickness of the plunger 18, the plunger 18 engages the interior surface 26 thereby preventing the plunger 18 from rotating, which would lead to liquid 32 spilling from the bottom end 22. Instead, the plunger 18 moves upward.

In alternative embodiments of the present invention, the exterior surface 24 has a flange 74 that extends outwardly along the bottom end 22 of the continuous wall 12 to provide additional support. In yet another embodiment, the continuous wall 12 has a cutout portion or angled portion 76 that is sized and shaped to accommodate a patient's 28 nose.

In one other embodiment of the present invention, the plunger 18 is raised by an automated system 86 that includes a moisture sensor 88, a pressure sensor 90, a level sensor 92, and an actuator 94, which are connected to a controller 96 and a power source 98. The moisture sensor 88 is positioned at or adjacent to the top end 20, and is configured to detect whether the liquid 32 is present. If the moisture sensor 88 detects an absence of the liquid 32, a signal is transmitted to the controller 96, which activates the actuator to raise the plunger 18 until the moisture sensor 88 detects the presence of the liquid 32.

The pressure sensor 90 and level sensor 92 send signals to the controller 98 to limit the activation of the automated system 86. The pressure sensor 90 is configured to detect whether the bottom end 22 of the adjustable drinking cup 20 is engaged a surface. The level sensor 92 is configured to determine whether the adjustable drinking cup 10 is being tilting or is positioned in an upright position. If it is detected that the adjustable drinking cup 10 is being lifted or tilted, a signal is sent to the controller 96 to prevent the actuator 96 from being activated until the adjustable drinking cup 10 is set back on a level or substantially level surface.

In operation, the plunger 18 is inserted into the bottom opening 16 through the bottom end 22 of the continuous wall 12. The plunger 18 is prevented from falling out of the bottom when the liquid 32 is added to near the top end 20 of the adjustable cup 10 due to the friction-fit of the plunger in addition to the bottom ring 62. At this point, the plunger 18 is at a first position 78.

The patient 28 then consumes approximately one-third of the liquid 32 by tilting the adjustable drinking cup 10 to pour liquid 32 into their mouth while either retaining their neck at a neutral position as shown in the Figures or with their chin tucked to avoid aspiration. The patient 28 then applies gentle pressure to the bottom surface 70 of the plunger 18 to raise the liquid a predetermined distance nearer the top end 20 again or to a second position 80 that is approximately one-third of the distance from the bottom end 22. In one embodiment, the patient 28 uses the indicia 30 on the exterior surface 24 for guidance. In still other embodiments, additional rings 64 stop the plunger 18 to prevent the liquid 32 from spilling.

The patient 28 again consumes one-third of the liquid while retaining a neutral position with their neck or with their chin tucked to limit the risk of aspiration. The patient 28 then presses the plunger 18 up another predetermined distance to a third position 82, which in one embodiment is two-thirds from the bottom 22. At this point, the plunger engages the top ring 60 that prevents the plunger 18 from raising further. In other embodiments, the patient 28 raises the liquid to any number of other positions 84 between the first position 78 and the third position 82.

Alternatively, a press the plunger 18 up the predetermined distances while still allowing the patient 28 to drink the liquid 32. This collaborative effort allows the patient 28 to retain a degree of independence and dignity, while freeing up the caregiver to accomplish other tasks and also preventing the caregiver from accidentally providing the patient 28 with too much liquid 32 commonly see with traditional cups. In other instances, the caregiver also pours the liquid 32 into the patient's 28 mouth.

After all of the liquid 32 has been consumed, the plunger is pressed downwards through the bottom opening 16 such that the plunger 18 is separated from the continuous wall 12. The adjustable drinking cup 10 can then be sanitized and reused.

Therefore, an adjustable drinking cup 10 has been provided that reduces the risk of aspiration, that is inconspicuous and retains a patient's dignity, that is easy to use, that is easy to clean and reuse, that improves hydration for patients with limited range of arm mobility, that is user friendly and has a limited number of parts, that maximizes the amount of fluid that can be held in the cup, and improves upon the art.

From the above discussion and accompanying figures and claims, it will be appreciated that the adjustable drinking cup 10 offers many advantages over the prior art. It will be appreciated further by those skilled in the art that other various modification could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. An adjustable drinking cup comprising:

a continuous wall, formed by an exterior surface and an interior surface, that extends from a top end to a bottom end that forms a top opening and a bottom opening;

the exterior surface extends upwardly and outwardly from the bottom end to the top end;

the interior surface having a first parallel portion and a second sloped portion;

a ring positioned along a first end of the second sloped portion; and a plunger received within the bottom opening.

2. The adjustable drinking cup of claim 1 further comprising the interior surface having one or more rings.

3. The adjustable drinking cup of claim 1 wherein the second sloped portion and the third parallel portion form a reservoir.

4. The adjustable drinking cup of claim 1 further comprising the plunger having a flat planar bottom surface.

5. The adjustable drinking cup of claim 1 wherein the plunger is automated.

6. The adjustable drinking cup of claim 1 further comprising the continuous wall having an angled portion configured to accommodate a patient's nose.

7. The adjustable drinking cup of claim 1 further comprising the continuous wall having a cut out portion.

8. The adjustable drinking cup of claim 1 further comprising the continuous wall having a cut out portion.

9. A method of using an adjustable drinking cup, comprising:

providing a plunger and a continuous wall that forms a top opening and a bottom opening; wherein the continuous wall has an interior surface having a first parallel portion and second sloped portion, and a ring positioned along the second sloped portion;

inserting the plunger within the bottom opening to form an interior of the adjustable drinking cup;

filling the interior with a liquid;

drinking a first predetermined amount of the liquid from the top opening;

pressing the plunger and the liquid upwardly a first predetermined distance from a bottom end of the continuous wall through the interior towards a top end thereby raising the liquid to a first position;

drinking a second predetermined amount of the liquid from the top opening; and pressing the plunger and the liquid upwardly a second predetermined distance from the bottom end of the continuous wall through the interior towards the top end thereby raising the liquid to a second position.

10. The method of claim 9 wherein during the steps of drinking a first predetermined amount of water and a second predetermined amount of water a neck of a patient is retained in a neutral position.

11. The method of claim 9 wherein during the steps of drinking a first predetermined amount of water and a second predetermined amount of water a chino chin of a patient is tucked.

12. An adjustable drinking cup comprising:

a continuous wall, formed by an exterior surface and an interior surface, that extends from a top end to a bottom end that forms a top opening and a bottom opening;

the interior surface having a first parallel portion and a second sloped portion;

a plunger received within the bottom opening; and wherein the top end extends outwardly in relation to and beyond the bottom end.

13. The adjustable drinking cup of claim 12 further comprising the top end having an angled portion configured to facilitate drinking from the top end.

14. The adjustable drinking cup of claim 12 wherein the plunger is configured for automated movement.

* * * * *